US012031278B2

(12) United States Patent
Thiesse et al.

(10) Patent No.: US 12,031,278 B2
(45) Date of Patent: Jul. 9, 2024

(54) AUTOMATED NULLING SCREED ASSEMBLY

(71) Applicant: Caterpillar Paving Products Inc., Brooklyn Park, MN (US)

(72) Inventors: Chad M. Thiesse, Brooklyn Park, MN (US); Anthony Paul Steinhagen, Maple Grove, MN (US); Ronald D. Wilson, Maple Grove, MN (US); Bryan J. Downing, Champlin, MN (US); Ricky Leon Mings, Oak Grove, MN (US); Mathew Hedrington, Ham Lake, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 276 days.

(21) Appl. No.: 17/355,285

(22) Filed: Jun. 23, 2021

(65) Prior Publication Data

US 2022/0412019 A1 Dec. 29, 2022

(51) Int. Cl.
*E01C 19/42* (2006.01)
*E01C 19/48* (2006.01)

(52) U.S. Cl.
CPC ..... *E01C 19/42* (2013.01); *E01C 19/4873* (2013.01); *E01C 2301/16* (2013.01)

(58) Field of Classification Search
CPC ... E01C 19/42; E01C 19/4873; E01C 2301/16
See application file for complete search history.

(56) References Cited

U.S. PATENT DOCUMENTS

| | | | | |
|---|---|---|---|---|
| 4,722,636 | A | 2/1988 | Brock | |
| 5,356,238 | A | 10/1994 | Musil et al. | |
| 5,568,992 | A * | 10/1996 | Grembowicz | E01C 19/48 404/101 |
| 6,158,921 | A | 12/2000 | Holmes | |
| 6,238,135 | B1 | 5/2001 | Roewer | |
| 6,685,390 | B1 * | 2/2004 | Eitzen | E01C 19/40 404/84.1 |
| 9,200,415 | B2 | 12/2015 | Graham et al. | |
| 2005/0207843 | A1 * | 9/2005 | Jackson | E04F 21/242 404/118 |
| 2014/0186115 | A1 * | 7/2014 | Graham | E01C 19/4873 404/75 |
| 2015/0139729 | A1 * | 5/2015 | Graham | E01C 19/40 404/84.1 |

(Continued)

FOREIGN PATENT DOCUMENTS

JP 2010222803 A 10/2010

*Primary Examiner* — Raymond W Addie

(57) ABSTRACT

A screed assembly is disclosed. The screed assembly has a screed frame that includes a main screed. Attached to the main screed is a drop arm that is used to attach the screed assembly to a work machine. An actuator device of the screed assembly adjust the main screed from a neutral position to a nulled position by rotating the main screed around an axis of the pivot pin. The screed assembly may further include a controller that determines whether the main screed is in the neutral position and adjust the main screed to the nulled position by sending a null adjustment signal to the actuator device, and the actuator device moving the main screed from the neutral position to the nulled position in response to the null adjustment signal.

20 Claims, 9 Drawing Sheets

(56) References Cited

U.S. PATENT DOCUMENTS

| | | | | |
|---|---|---|---|---|
| 2019/0145063 | A1* | 5/2019 | Jorgensen | E01C 19/48<br>404/118 |
| 2020/0076337 | A1* | 3/2020 | Abbott | H02K 11/0094 |

* cited by examiner

AUTOMATED NULLING SCREED ASSEMBLY

TECHNICAL FIELD

The present disclosure generally relates to paving machines, and more specifically to a screed assembly for a paving machine.

BACKGROUND

When constructing roads, bridges, parking lots and other such surfaces, paving machines may be used to deposit, spread and compact paving material, such as asphalt, on a base surface, ground surface, thereby creating a flat, consistent surface over which vehicles will travel. A paving machine generally includes a tractor portion having a chassis and a hopper for storing the paving material, an auger that distributes the paving material on a base surface and a screed assembly that levels and compacts the paving material, ideally leaving a mat of uniform depth and smoothness. The screed assembly is typically rear-mounted on the paving machine behind the hopper, the chassis and the auger relative to the direction of travel. Further, the screed assembly is typically drawn behind the paving machine by a pair of pivotally mounted tow arms.

Among other things, the screed assembly may include a main screed and one or more extension screeds. The extension screeds are laterally extendable from the main screed to adjust for varying base surface widths. In addition, the main screed and the extension screeds may each include bottom-facing screed plates that facilitate the compacting and leveling of the paving material on the base surface. Screeds typically pave with a slight nose up angle of attack in the paving direction for optimal screed paving performance of floatability, stability, screed plate wear, and pre-compaction. To get the main screed and any extensions screeds in this optimal nose up angle of attack, a process called nulling the screed is used.

U.S. Pat. No. 5,356,238 discloses a screed with an actuator for adjusting screed angle to achieve a nulling position through inputs provided at the operator station. Sensors are provided to monitor the current angle or position of the screed.

While effective, there remains a need for improved screed assemblies for work machines used in high wear applications, such as paving.

SUMMARY

In accordance with one aspect of the present disclosure, a screed assembly is disclosed. The screed assembly has a screed frame that includes a main screed. Attached to the main screed is a drop arm that is used to attach the screed assembly to a work machine. An actuator device of the screed assembly adjusts the main screed from a neutral position to a nulled position by rotating the main screed around an axis of the pivot pin. The screed assembly further has a controller that determines if the main screed is in the neutral position and adjust the main screed to the nulled position by sending a null adjustment signal to the actuator device, and the actuator device rotating the main screed from the neutral position to the nulled position in response to the null adjustment signal.

In accordance with another aspect of the present disclosure, a work machine is disclosed. The work machine has a tractor portion that includes a frame, a traction system which supports the frame and is used to move the traction portion along a paving reference, and the frame supports an operation station. The work machine further includes a screed assembly, which has a screed frame that includes a main screed. Attached to the main screed is a drop arm that is used to attach the screed assembly to the work machine. An actuator device of the screed assembly adjusts the angle of attack of the main screed from a neutral position to a nulled position by rotating the main screed around an axis of the pivot pin. The screed assembly further has a controller that determines if the main screed is in the neutral position and adjust the main screed to the nulled position by sending a null adjustment signal to the actuator device, and the actuator device rotating the main screed from the neutral position to the nulled position in response to the null adjustment signal.

In accordance with a further aspect of the present disclosure, a method of automatedly nulling a screed is disclosed. The method includes attaching a main screed of a screed frame to a work machine with a drop arm, with the drop arm attached to the main screed by a drop arm pivot pin. After the main screed is attached, a controller of determines if the main screed is in a neutral position and sends a null adjustment signal to an actuator device. The actuator device adjust the main screed from the neutral position to a nulled position by rotating the main screed around an axis of the drop arm pivot pin in response to the null adjustment signal.

These and other aspects and features of the present disclosure will be more readily understood when read in conjunction with the accompanying drawings.

DETAILED DESCRIPTION

Figure 1:
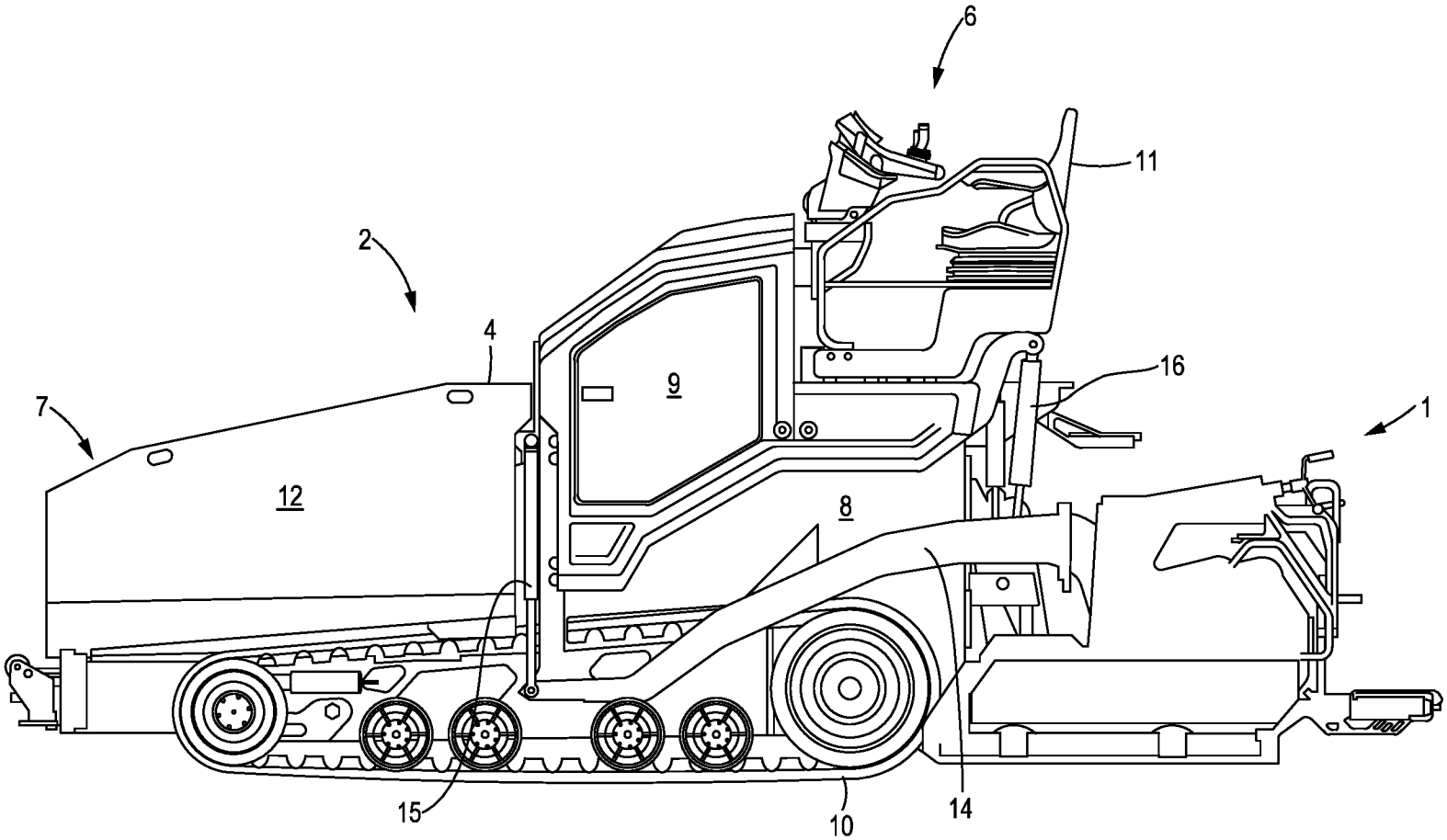
FIG. 1 is a side view of an exemplary work machine having a screed assembly, in accordance with the present disclosure.

Referring to FIG. 1, a screed assembly 1, is attached to a work machine 2. The work machine 2 may embody a fixed or mobile machine that performs some type of operation associated with an industry such as paving, construction, farming, transportation, or any other industry known in the art. For example, the work machine 2 may be an asphalt compacting machine such as an asphalt paving machine, as shown, or a backhoe, an excavator, a dozer, a loader, or any other construction machine. The work machine 2 may be used primarily as a paving tool to deposit, spread, and compact paving material, such as asphalt, on a paving reference 3 (shown in FIG. 6), such as an existing prepared base surface, ground surface, or starting depth boards, thereby creating a flat, consistent surface over which vehicles will travel.

The work machine 2 generally includes a tractor portion 4 which propels the work machine 2 and supports an operator control station 6, an asphalt conveyor system 7, and the screed assembly 1. The tractor portion 4 propels the work machine 2 at a steady rate along the paving reference 3 and includes a frame 8, an engine 9 supported by the frame 8, and ground engaging elements 10 supporting the frame 8 and driven by the engine 9. The ground engaging devices 10 may be tracks as shown, or any other similar device such as wheels.

The operator control station 6 may be configured to provide operator control over the work machine 2. The operator control station 6 may include one or more operator seats 11. In one embodiment, the operator control station 6 may be mounted to the frame 8 proximal to the rear of the tractor portion 4.

The asphalt conveyor system 7 is configured to transfer hot asphalt material or other paving material from a truck (not shown) in front of the work machine 2, through the tractor portion 4, and to the paving reference 3 at the rear of the work machine 2. A hopper 12 may be positioned at the front of the work machine 2 and may contain the paving material that is to be formed into a mat on the paving reference 3. The paving material may be dumped into the hopper 12 from trucks (not shown) that deliver the paving material to a worksite. The work machine 2 may also include one or more conveyors (not shown) at the bottom of the hopper 12. The conveyors transport the paving material from the hopper 12 to the rear of the tractor portion 4. The work machine 2 may further include one or more augers (not shown) or other material feed components instead of or in addition to the conveyors. The augers distribute the paving material in front of the screed assembly 1 positioned at the rear end of the tractor portion 4. As the work machine travels forward, the paving material is evenly spread and compacted by the screed assembly 1.

The screed assembly 1 may be pivotably attached to the tractor portion 4 by a drop arm 14 on each side of the frame 8 and towed behind the tractor portion 4 to spread and compact the paving material into a layer or mat of desired thickness, width and uniformity. The drop arms 14 are pivotally connected to each side of the frame 8 such that the relative position and orientation of the screed assembly 1 relative to the frame 14 and to the surface being paved, the paving reference 3, may be adjusted by raising or lowering the drop arms 14 via tow arm actuators 15. The tow arm actuators 15 may be any suitable actuators, such as, for example, the hydraulic cylinders depicted.

The screed assembly 1 may also be connected to the tractor portion 4 by a lifting assembly 16. The lifting assembly 16 is configured to move the screed assembly 1 between a lowered position (shown in FIG. 1) and a raised position (not shown). The raised position allows the paving machine 2 to move more easily when the paving functions are not required. In the lowered position, the screed assembly 1 is able to perform its flattening and compacting function. The lowered position may be the lowest position possible as set by the paving reference 3 or mechanical stops, or it may be a desired height above the lowest point as required for a particular use of the work machine 2. That height may be set by the operator and measured by height sensors (not shown).

The lifting assembly 15 may include a plurality of lift cylinders or other actuators (not shown) connected to the top of the screed assembly 1. In some embodiments, the lift cylinders may also provide further control over the paving process by applying additional downward force to the screed assembly 1.

Figure 2:
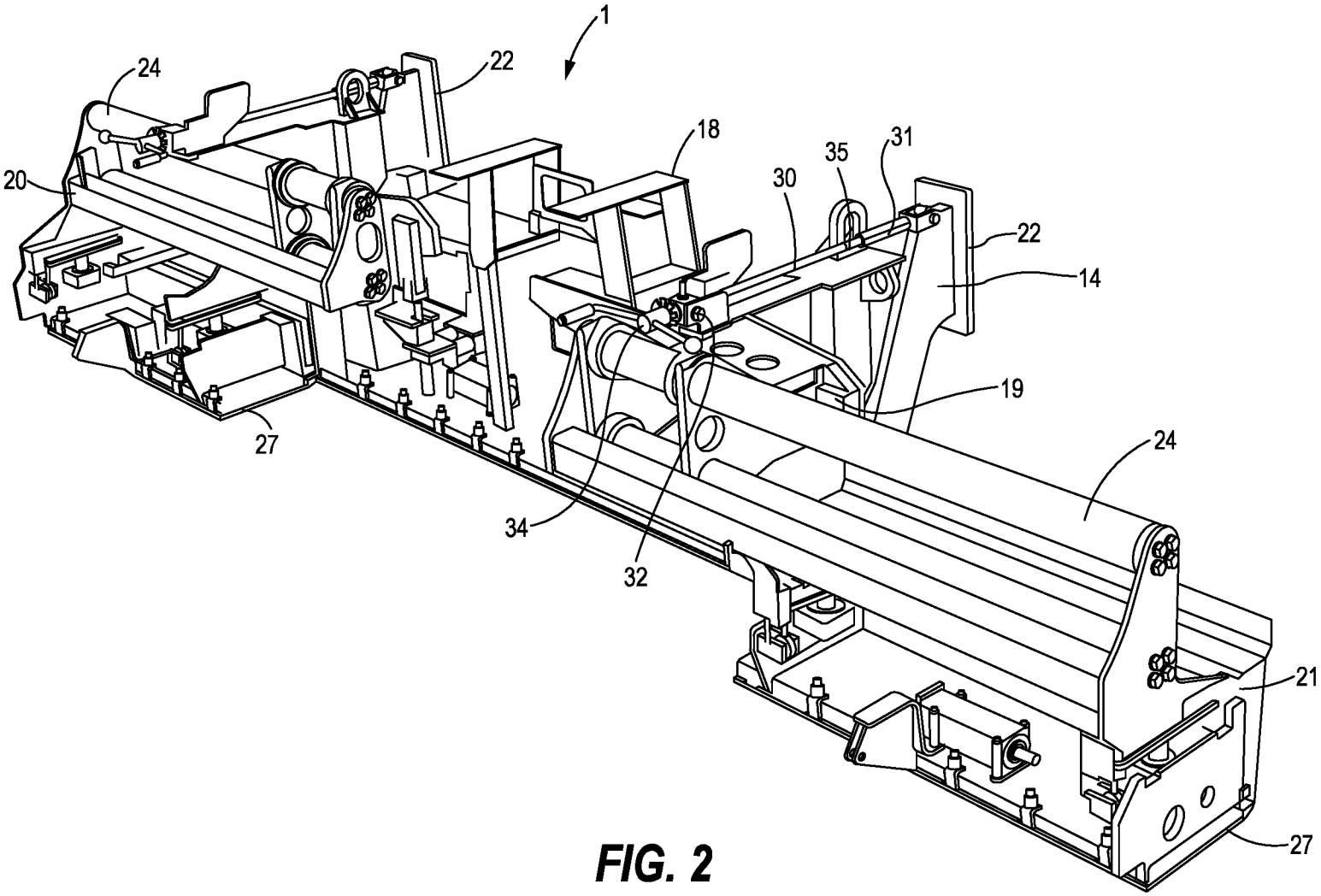
FIG. 2 is a perspective view of the exemplary screed assembly, in accordance with the present disclosure.
Figure 3:
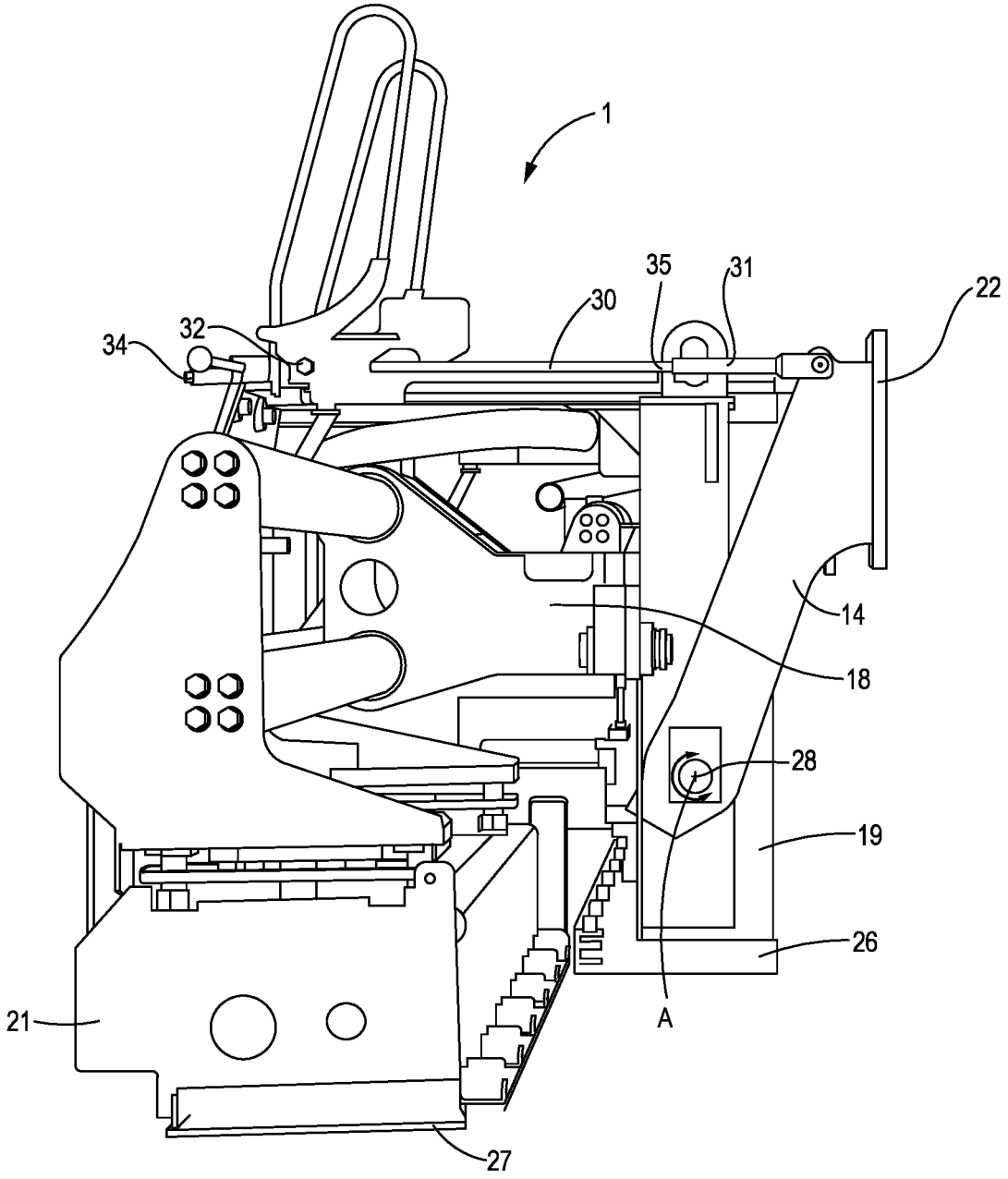
FIG. 3 is a perspective side view of the screed assembly of FIG. 1, in accordance with the present disclosure.

The screed assembly 1 may be a compilation of components that cooperate to shape, level, and compact an asphalt mixture delivered from the hopper onto a base surface and may have any of a number of configurations known in the industry. FIGS. 2 and 3 depicts an exemplary screed assembly 1. The screed assembly 1 may include a screed frame 18, a main screed 19, and a left hand extensions screed 20 and right hand extension screed 21 that extend laterally from the screed frame 18 when in use. The screed frame 18 of the screed assembly 1 may be operatively connected to the tractor portion frame 4 via the drop arms 14 at a drop arm attachment end 22.

Figure 4:
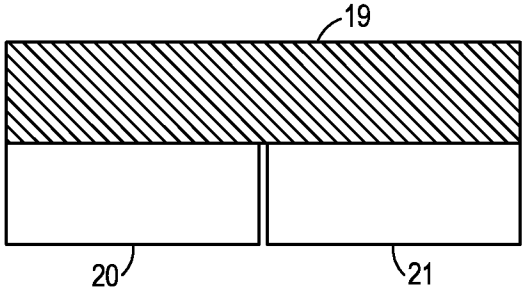
FIG. 4 is diagrammatic top view of the screed assembly of FIG. 1 with the left screed extender and the right screed extender in a retracted position, in accordance with the present disclosure.
Figure 5:
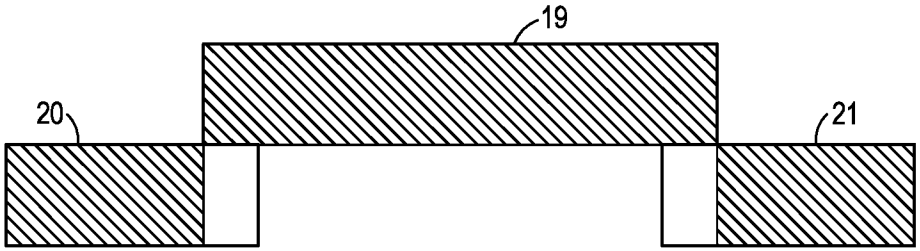
FIG. 5 is diagrammatic top view of the screed assembly of FIG. 1 with the left screed extender and the right screed extender in an extended position, in accordance with the present disclosure.

As best shown in FIGS. 4 and 5, the left hand and right hand extension screeds 20, 21 may be moved in-and-out relative to the main screed 19 by way of one or more hydraulic actuators 24 (FIG. 2) from a retracted position shown in FIG. 4 to an extended position shown in FIG. 5, so as to adjust a width of the resulting layer of asphalt laid down by the screed assembly 140 as needed for a particular paving job. It should be noted, however, that in other exemplary embodiments the left hand and right hand extension screeds 20, 21 may be omitted, include only one extension screed, or the left hand 20 or right hand 21 extension screed are fixed in place. In a further exemplary embodiment, the left hand 20 or right hand 21 extension screeds 20, 21 are attached in front of the main screed 19, instead of behind as depicted in FIGS. 2-8.

Referring back to FIGS. 2-3, the main screed 19 may include a main screed plate 26. In operation, the main screed plate 24 will smooth and compress paving material as the screed assembly 1 (and the main screed 19) is floatingly pulled by the work machine 2 over the paving material. The main screed plate 26 may be comprised of a single plate as illustrated, or a plurality of connected plate sections (not shown). The left hand and right hand extension screeds 21, 21 may similarly each include an extension screed plate 27 comprised of a single plate as illustrated, or a plurality of connected plate sections (not shown).

The drop arms 14 are rotatably attached to the main screed 19 by a drop arm pivot pin 28 on both sides of the main screed 19. Once the screed assembly is fixedly attached to the tractor portion 4 of the work machine 2, the drop arm pivot pins 28 allows the main screed 19, screed frame 18, and any extension screeds, such as the left hand and right hand extension screeds 20, 21, to rotate, relative to the tractor portion 4, around an axis A of rotation. To control this rotation, the screed assembly 1 includes threaded thickness screws 30 that are attached to the drop arm 14 at threaded thickness screw receivers 31 and attached to the screed frame 18 at a threaded thickness screw attachment point 32. A threaded thickness screw handle 34 is turned by an operator of the work machine 2 in order to extend and retract the threaded end 35 of the threaded thickness screws 30 into the threaded thickness screw receivers 31. This extending and retracting of the threaded thickness screws 30 rotates the main screed 19, screed frame 18, and any extension screeds, such as the left hand and right hand extension screeds 20, 21 around the axis A of rotation.

To set up the screed assembly 1 for a paving process, the left hand and right hand extender plates 20, 21 are first raised about 6 millimeters, or between 3-9 millimeters, above the main screed plate 26. The primary screed is floated on the starting paving reference 3, thereby supporting the entire screed assembly 1 weight on the paving reference 3. When the screed assembly 1 weight is supported on the paving reference, the main screed and the left hand and right hand extension screeds 20, 21, are considered in a neutral position. A neutral position, in another exemplary embodiment, includes any pre-determined height of the main screed 19, or the left hand and right hand extension screeds 20, 21, above the paving reference or engaged with the paving reference.

Figure 6:
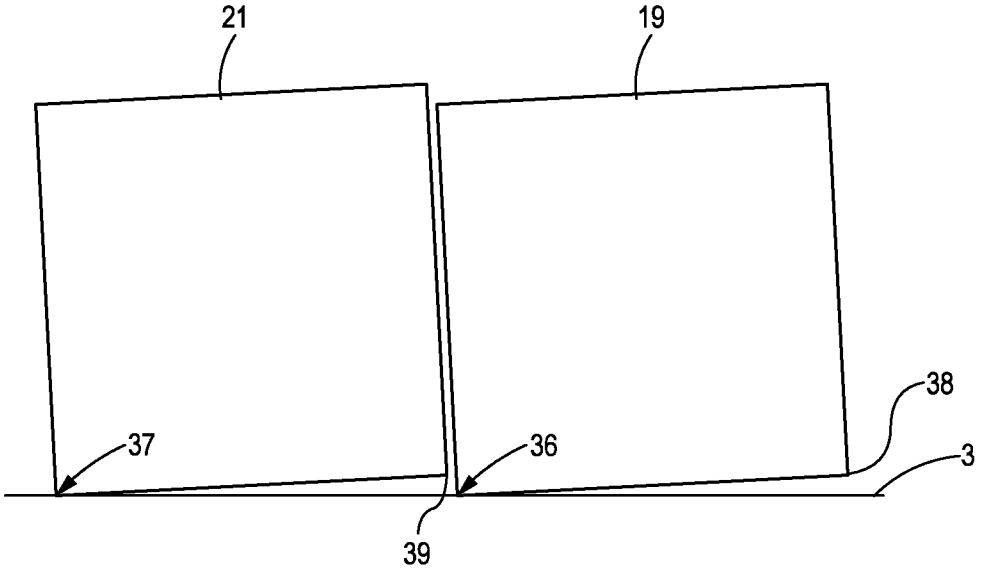
FIG. 6 is diagrammatic side view of the screed assembly of FIG. 1 with the main screed and the right screed extender in a nulled position, in accordance with the present disclosure.

After the primary screed 19, or the left hand and right hand extension screeds 20, 21, are in the neutral position, a nulling process occurs. In one exemplary process, the nulling process first includes pulling the tractor portion 4 forward slightly until any loose slack in all the screed pin joints, such as the drop arm pivot pin 28, has been removed. In the nulling process an operator of the work machine 2 actuates both the threaded thickness screw handles 34, in which the turning of the threaded thickness screw handles 34 actuates the right hand and left hand threaded thickness screws, such as threaded thickness screw 30, rotating the main screed 19, screed frame 18, and any extension screeds, such as the left hand and right hand extension screeds 20, 21 around the axis A of rotation as described above. This actuation is continued until there is no tension felt in each of the left hand and right hand threaded thickness screws, such as threaded thickness screw 30. When the left hand and right hand extension screeds 20, 21 have no tension, the screed is considered in a nulled position. As best shown in FIG. 6, in the nulled position the entire weight of the screed assembly is supported on the main screed trailing edge 36, and the trailing extension screed trailing edge 37, if any extensions screeds are included with the screed assembly 1, such as the left hand and right hand extension screeds 20, 21. As discussed above, in the first step of the nulling process, since the left hand and right hand extension screeds 20, 21 were previously raised 3-9 millimeters relative to the main screed plate 26, the screed assembly 1 being supported on main screed trailing edge 36 and the extension screed trailing edge 37, if included, results in the nose up angle of attack as depicted in FIG. 6. In the nose up angle of attack, a leading edge of the main screed 38, and a leading edge of the extension screeds 39, if included, are raised 6 millimeters higher than their respected trailing edges 36, 37. In other exemplary embodiment any leading edges 38, 39 are raided between 0.1-5 millimeters, 6-8 millimeters, or 9-15 millimeters.

After the primary screed 19, or the left hand and right hand extension screeds 20, 21, if included (hereinafter referred to as the screeds 19, 20, 21), are in the nulled position, the screed assembly is in a loose state. The loose state includes any slope/slack in all pin joints of the screed apparatus, including and any slope, slack, or looseness in the drop arm pivot pin 28, between the threaded thickness screws and their attachment points 32, the threaded thickness screw receivers 31 and the drop arms 14, or any of the hydraulic actuators or the lifting assembly of screed assembly 1. To remove this looseness, slope, slack, the operator of the work machine 2 further actuates the threaded thickness screw handles 34 in the same direction as during the nulling process, in which actuates the threaded thickness screws 30, until tension is felt in the threaded thickness screws 30. This actuation, in one exemplary embodiment, cause the screeds 19, 20, 21 to further rotate in the direction of rotation used in the nulling process, resulting in an increased nosed up angle of attack. This increase in nose up angle of attack is smaller than the increase of angle of attack of the nulling process, and may be 0.001-1 millimeters, 1-2 millimeters, 2-3 millimeters, depending on how much looseness, slope, or slack exist in the screed assembly 1. This increase in nose up angle of attack, after the screeds 19, 20, 21 are in the nulled position, applies a pre-tension to the screed assembly and places the screed assembly into a rigid state. The rigid state being after the pre-tension is applied to the screed assembly 1 that was previously in the nulled position.

Figure 7:
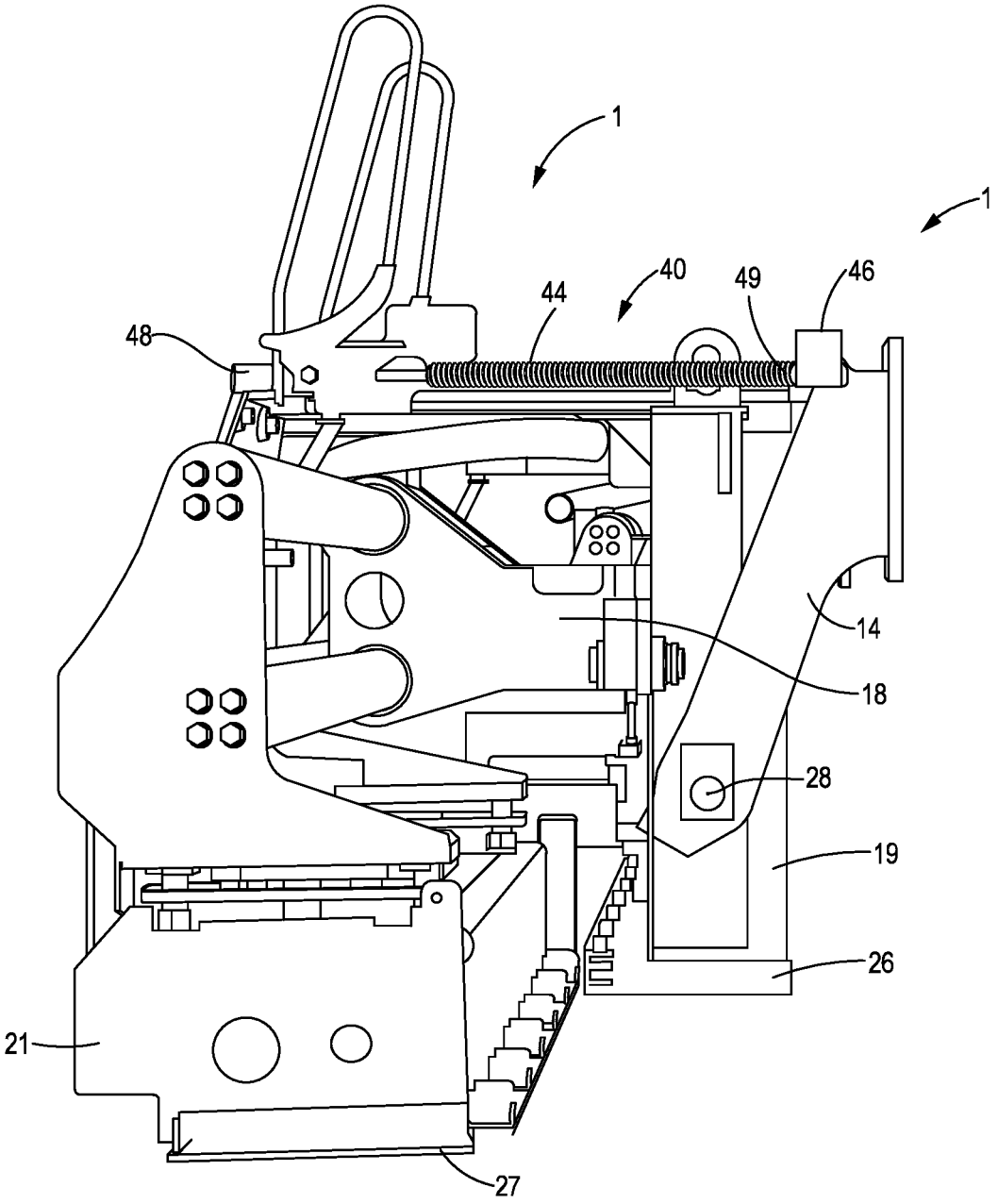
FIG. 7 is a perspective side view of an exemplary screed assembly, in accordance with the present disclosure.

FIG. 7 illustrates an exemplary embodiment of the screed assembly 1 that differs from the above described exemplary embodiments by including an actuator device 40 instead of threaded thickness screws 30 and threaded thickness screw handles 34 for rotation of the screeds 19, 20, 21 from the neutral position to the nulled position, and applying any pre-tension to place the screed assembly 1 in the rigid state after rotation into the nulled position. In one exemplary embodiment the actuator device 40 is a linear actuator 42 that includes a rod 44 and an electric motor 46. The rod 44 may be an external or internally threaded rod, and is connected to the screed frame 18 at a rod first end 47, and the drop arm 14 at a rod second end 49. Further, as illustrated the electric motor 45 is attached to the drop arm 14, but may be mounted to the screed frame 18, or the primary screed 19. The electric motor 45 extends and retracts the rod 44, relative to the electric motor 45, for adjusting screeds 19, 20, 21 from the neutral to the nulled positions by rotating the screeds 19, 20, 21 around the axis A of the drop arm pivot pin 28, as discussed above. Once in the nulled position, the linear actuator 42 is also used to apply any pre-tension to place the screed assembly 1 into the rigid state.

Figure 8:
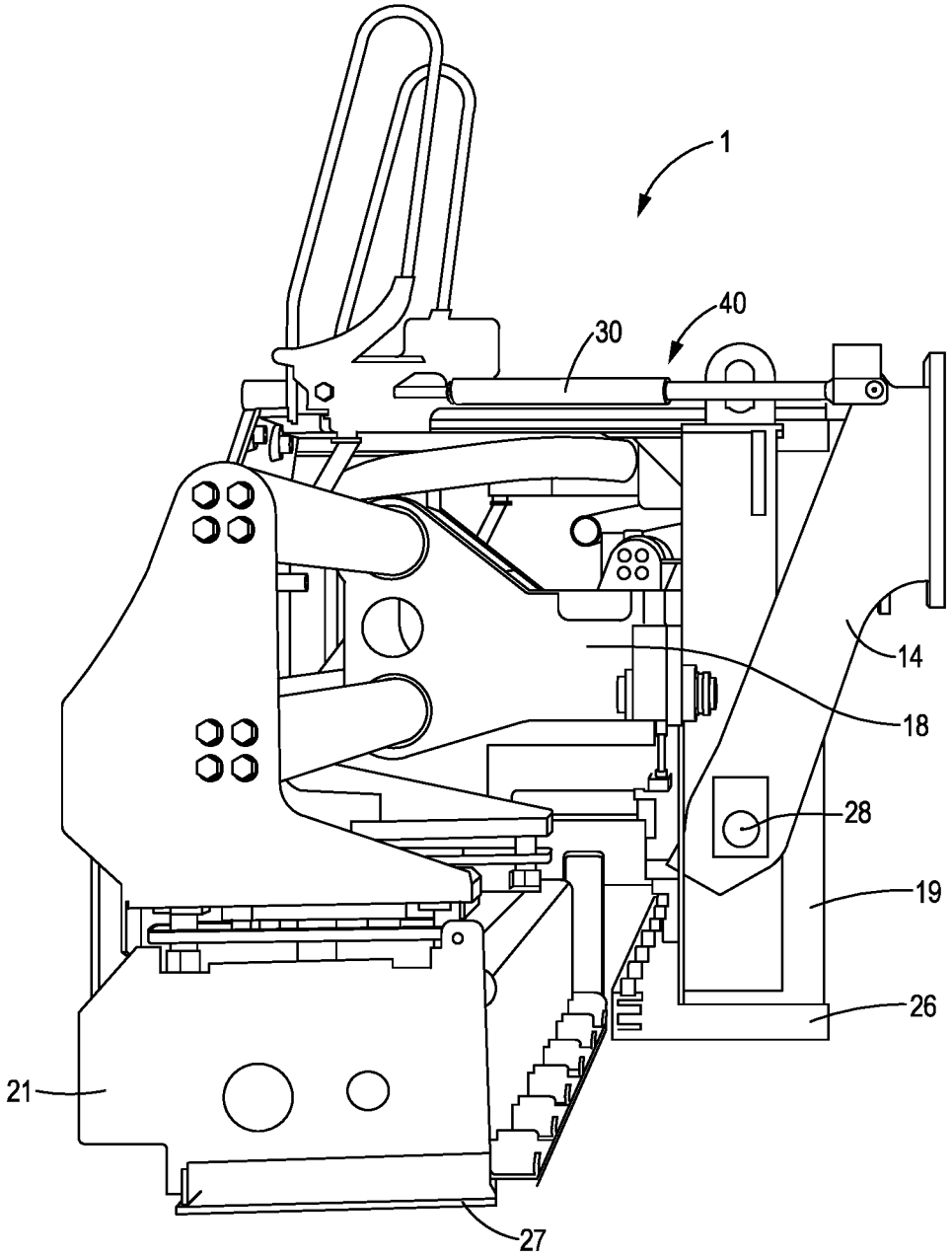
FIG. 8 is a perspective view of an exemplary screed assembly, in accordance with the present disclosure.

FIG. 8 illustrates an exemplary embodiment of the screed assembly 1 that differs from the above described exemplary embodiments by including an actuator device 40 instead of threaded thickness screws 30 and threaded thickness screw handles 34 for rotation of the screeds 19, 20, 21 from the neutral position to the nulled position, and applying any pre-tension to place the screed assembly in the rigid state after rotation into the nulled position. In one exemplary embodiment the actuator device is a hydraulic actuator 50. The hydraulic actuator 50 is connected to the screed frame 18 at one of its ends, and the drop arm 14 at its other end. The hydraulic actuator 50 extends and retracts for adjusting the screeds 19, 20, 21 from the neutral to the nulled positions by rotating the screeds 19, 20, 21 around the axis A of the drop arm pivot pin 28, as discussed above. Once in the nulled position, the hydraulic actuator 50 is also used to apply any pre-tension to place the screed assembly 1 into the rigid state.

The screed assembly 1 of the work machine 2 may also include additional components and systems, such as, for example, tamper devices, leveling arms, vibrators, heating elements and walkways (not shown), as are known to those skilled in the art.

Figure 9:
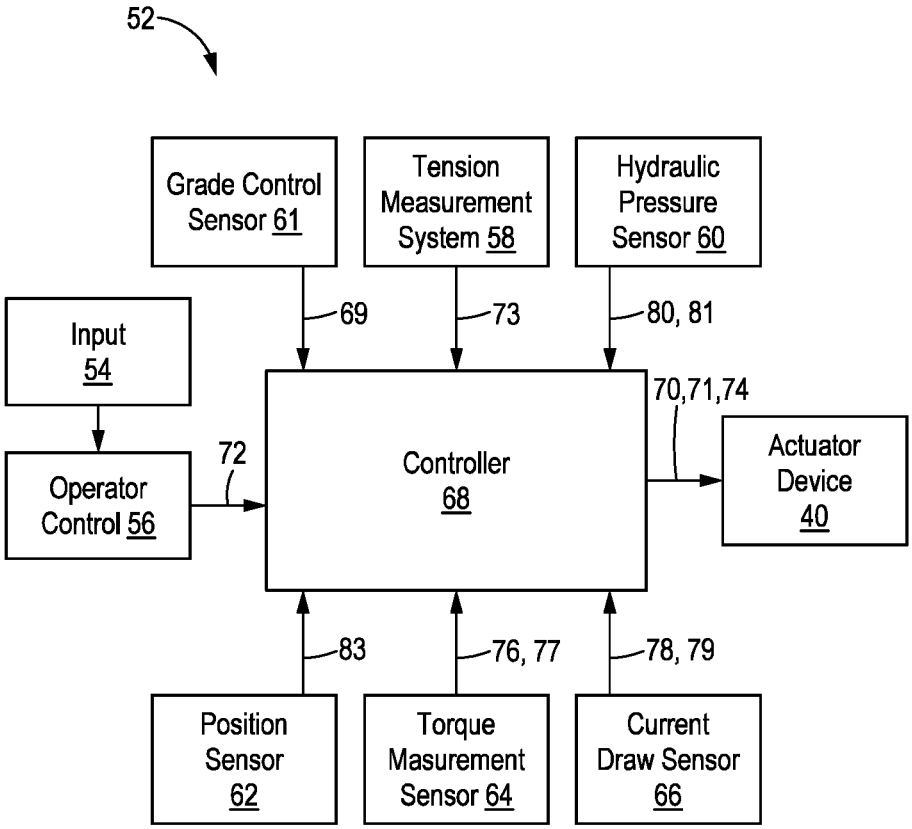
FIG. 9 is a block diagram of a screed nulling control system for the work machine, in accordance with the present disclosure.

Turning to FIG. 9, is a schematic block diagram of a screed nulling control system 52 for the work machine 2. The screed nulling system is designed to control the automated nulling and application of pre-tension of the screed assembly 1. The screed nulling control system 52 includes an input 54, operator control 56, tension measurement system 58, hydraulic pressure sensor 60, position system 62, torque measurement sensor 64, current draw sensor 66, controller 68, and the actuator device 40. The controller 68 receives data from the sensors 60, 61, 62, 64, 66, the systems 58, or the operator control 56 and is configured to send a null adjustment 70, or rigid state adjustment 71, to the actuator device 40, the actuator device 40 moving the screeds 19, 20, 21 from the neutral position to the nulled position in response to the null adjustment signal 70, or from the loose state to the rigid state in response to the rigid state adjustment signal 71.

In one exemplary embodiment, prior to sending the null adjustment signal 70, the controller 68 determines the screeds 19, 20, 21 are in the neutral position from the grade control sensor 61, or any height measurement sensors (not shown). After the screed assembly 1 is attached to the work machine 2, the grade control sensor 61 measures the position, or the height, of the screeds 19, 20, 21, with respect to the paving reference 3, and sends a grade control measurement 69 to the controller 68, the controller 68 utilizing the measurement 69 to determine if the screeds 19, 20, 21 are in the neutral position. Further, in one exemplary embodiment, the work machine 2 may include the operator control 56 that receives the input 54 from the operator of the work machine 2. Once the input 54 is received, a screed assembly nulling signal 72 is sent to the controller 68 prior to the controller determining if the screeds 19, 20, 21 are in the neutral position. In a further exemplary embodiment, the controller is automated to determine if the screeds 19, 20, 21 are in the neutral position after the screed assembly 1 is attached to the work machine 2 without receiving the screed assembly nulling signal 72.

In one exemplary embodiment, the screed assembly 1 includes the tension measurement system 58, that is located on the screed assembly 1. The tension measurement system 58 takes a measurement, after the screed assembly 1 is in the nulled position, to determine a tension state of the screed assembly 1. The tension state can be the loose state or the rigid state, as described above. In one exemplary embodiment, embodiment, the tension measurement system 58 takes a tension measurement 73, the tension measurement 73 being a measurement of all the pin joints in the screed assembly 1, and sends the tension measurement 73 to the controller 68. After receiving the tension measurement 73, the controller 68 sends the rigid state adjustment signal 71 to the actuator device 40, wirelessly or through a physical connection, and the actuator device 40 places the screed assembly 1 into the rigid state.

As discussed above, the actuator device may be the linear actuator 42. In that embodiment, after the screeds 19, 20, 21 are in the nulled position, the controller 68 sends a predetermined rigid state adjustment signal to the actuator device 40 prior to the actuator device 40 placing the screed assembly into the rigid state. The pre-determined rigid state adjustment signal 74 is a pre-determined amount of turns the electric motor 46 extends or retracts the rod 44, or turns the rod 44, to place the screed assembly 1 into the rigid state. The amount to extend or retract rod 44 is pre-determined by the size of the components that make up the screed assembly 1.

In a further embodiment, the electric motor 45 includes the torque measurement sensor 64. After the screeds 19, 20, 21 are in the neutral position, the torque measurement sensor 64 senses and measures the amount of torque in the electric motor 46, or the amount of torque the electric motor is placing on the rod 44. The torque measurement sensor 64 sends a torque measurement 76, or continuously measures and sends the measurements to the controller 68, and the controller 68 utilizes the torque measurement to determine that the screeds 19, 20, 21 are in the nulled position and stops the linear actuator 42 from further rotating the screeds 19, 20, 21 once the screeds 19, 20, 21 are in the nulled position, thus placing the screed assembly 1 into the nulled position. Further, after the screeds 19, 20, 21 are in the nulled position, the torque measurement sensor 64 takes a second measurement, or continuously measures, and sends a second torque measurement 77 to the controller 68. The controller 68 utilizes the second torque measurement 77 to determine the tension state of the screed assembly 1 prior to the controller sending the rigid state adjustment signal 71 to the actuator device 40 to place the screed assembly 1 in the rigid state.

Instead of, or in addition to, the torque measurement sensor 64, the electric motor includes a current draw sensor 66 to measure a current draw of the electric motor. After the screed assembly 1 is in the neutral position, the current draw sensor 66 takes, or continuously takes, the measurement and sends a current draw measurement 78 to the controller 68, and the controller 68 utilizing the current draw measurement 78 to determine the screeds 19, 20, 21 are in the nulled position based on the measured current draw. Further, after the screed assembly 1 is in the nulled positioned, the current draw sensor 66 may take, or continuously take further measurements, of the current draw of the electric motor 46, and send a second current draw measurement 79 to the controller 68. The controller utilizing the second current draw measurement 79 to determine the tension state of the screed assembly 1, and the controller sending the rigid state adjustment signal 71 to the actuator device 40.

Also discussed above, the actuator device may be the hydraulic actuator 50. The hydraulic actuator 50, in one exemplary embodiment, includes the hydraulic pressure sensor 60. In the neutral position, the hydraulic pressure sensor takes a measurement of, or continuously measures, the hydraulic pressure in the hydraulic actuator 50, and sends a hydraulic pressure measurement 80 to the controller 68. The controller 68 utilizes the hydraulic pressure measurement 80 to determine that the screed assembly 1 is in the nulled position, and stops the actuator device from rotating screeds 19, 20, 21 once the nulled position is achieved. Once in the nulled position, the hydraulic pressure sensor may further take a measurement of, or continuously measure, the hydraulic pressure in the hydraulic actuator 50 and send a second hydraulic pressure measurement 81 to the controller 68. The controller utilizing the second hydraulic pressure to determine a tension state of the screed assembly 1 and send the rigid state adjustment signal 71 to the actuator device 40 place the screed assembly 1 in the rigid state.

Instead of, or in addition to, the hydraulic pressure sensor 60, the hydraulic actuator 50 includes the position sensor 62. In the nulled position, the position sensor 62 takes a measurement of, or continuously measures, the position of the hydraulic actuator 50, such as a measurement of a hydraulic rod to its cylinder, for example, and sends a position measurement 83 to the controller 68. The controller 68 utilizes the position measurement 83 to determine the tension state of the screed assembly 1, and sends the rigid state adjustment signal 71 to the actuator device 40 to place the screed assembly in the rigid state.

INDUSTRIAL APPLICABILITY

In general, the teachings of the present disclosure may find applicability in many industries including, but not limited to, asphalt paving machines. More specifically, the teachings of the present disclosure may find applicability in any industry using screed assemblies in a paving operation, such as, but not limit to, paving, construction, excavating, and the like.

In accordance with the scope of the present disclosure, in one such operation it is desirable to automate the nulling of a screed assembly and application of pre-tension to place the screed assembly in a rigid state. The present disclosure provides a method for automatedly nulling a screed.

Figure 10:
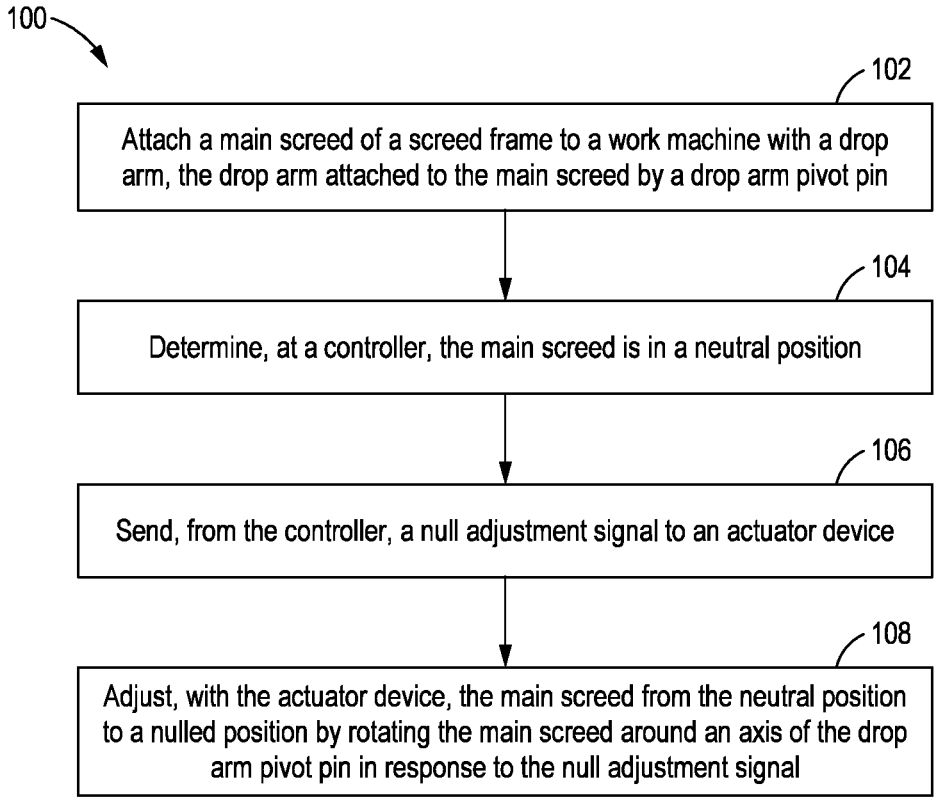
FIG. 10 is a flow chart illustrating an autonomous method of automatedly nulling a screed.

Turning now to FIG. 10, with continued reference to FIGS. 7-9, a flowchart illustrating an exemplary method 100 for automatedly nulling a screed assembly 1. At block 102, a main screed 19 of a screed frame 18 is attached to a work machine with a drop arm 14. The drop arm 14 is attached to the main screed by a drop arm pivot pin 28. At block 104, a controller 68 determines that the main screed 19 is in a neutral position. The controller 68, at block 106 sends a null adjustment signal 70 to an actuator device 40. The actuator device may be a linear actuator 42 or a hydraulic actuator 50, and utilize a number of sensors 60, 61, 62, 64, 66, systems 58, or the operator control 56 to send measurements or data to the controller 68 prior to the controller utilizing such measurements or data to determine and send the null adjustment signal 70. In response to receiving the null adjustment signal 70, at block 108, the actuator device 50 adjust the main screed 19 from the neutral position to a nulled position by rotating the main screed 19 around an axis A of the drop arm pivot pin 28. The controller may further receive measurements or data from the sensors 60, 61, 62, 64, 66, systems 58, or the operator control 56 after the screed assembly 1 is in the nulled position, and send a rigid state adjustment signal 71 to the actuator device 40, the actuator device 40 applying pre-tension to place the screed assembly into a rigid state.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A screed assembly, comprising:

a screed frame including one or more screeds including a main screed;

a drop arm attached to the main screed by a drop arm pivot pin, and the drop arm configured to attach the screed assembly to a work machine;

an actuator device configured to:

adjust the screed assembly from a neutral position to a nulled position by rotating the one or more screeds around an axis of the drop arm pivot pin, the neutral position being when the main screed is supporting the full weight of the screed assembly on a paving reference and the nulled position being when each trailing edges of the one or more screeds are supporting the full weight of the screed assembly on the paving reference, and there exists a loose state, where there is looseness in a pin joint of the screed assembly; and adjust the screed assembly from the loose state to a rigid state by further rotating the one or more screeds around the axis of the drop arm pivot pin, the rigid position being when the looseness is removed from the pin joint; and a controller configured to:

determine the screed assembly is in the neutral position based on a grade control measurement received from a grade control sensor, and the controller configured to automatically adjust the screed assembly to the nulled position if the controller determines the screed assembly is in the neutral position by sending a null adjustment signal to the actuator device, the actuator device rotating the screed assembly from the neutral position to the nulled position in response to the null adjustment signal; and determine the screed assembly is in the loose state and configured to adjust the screed assembly to the rigid state if the controller determines the screed assembly is in the loose state by sending a signal to the actuator device, the actuator device rotating the screed assembly from the nulled position to the rigid state in response to the signal.

2. The screed assembly of claim 1, in which the screed assembly includes a tension measurement system, the tension measurement system sending a tension measurement to the controller after the screed assembly is in the nulled position, the controller utilizing the tension measurement to determine a tension state of the screed assembly, the controller automatically sending a rigid state adjustment signal to the actuator device if the controller determines the screed assembly is in the loose state based on the tension measurement, the actuator device rotating the screed assembly into the rigid state.

3. The screed assembly of claim 2, in which the actuator device is a linear actuator and includes a rod attached to the screed frame and the drop arm, and an electric motor, the linear actuator configured to adjust the main screed to the nulled position.

4. The screed assembly of claim 3, in which when the main screed is in the nulled position, the controller sends a pre-determined rigid state adjustment signal to the actuator device to further rotate the main screed to place the screed assembly in the rigid state.

5. The screed assembly of claim 3, in which the electric motor includes a torque measurement sensor, the torque measurement sensor sending a torque measurement to the controller, and the controller utilizing the torque measurement to determine that the main screed is in the nulled position.

6. The screed assembly of claim 5, in which the torque measurement sensor sends a second torque measurement to the controller after the main screed is in the nulled position, the controller utilizing the second torque measurement to determine the tension state of the screed assembly, and the controller sending the rigid state adjustment signal to the actuator device to place the main screed in the rigid state.

7. The screed assembly of claim 3, in which the electric motor includes a current draw sensor to measure a current draw of the electric motor, the current draw sensor sending a current draw measurement to the controller, and the controller utilizing the current draw measurement to determine that the main screed is in the nulled position.

8. The screed assembly of claim 7, in which the current draw sensor sends a second current draw measurement to the controller after the main screed is in the nulled position, the main screed utilizing the second current draw measurement to determine the tension state of the screed assembly, and the controller sending the rigid state adjustment signal to actuator device to place main screed in the rigid state.

9. The screed of claim 3, in which the actuator device is a hydraulic actuator attached to the screed frame and the drop arm, and the hydraulic actuator is configured extend and retract to adjust the main screed to the nulled position.

10. The screed of claim 9, in which the actuator device includes a hydraulic pressure sensor, the hydraulic pressure sensor sending a hydraulic pressure measurement to the controller, and the controller utilizing the hydraulic pressure measurement to place the main screed is in the nulled position.

11. The screed assembly of claim 10, in which the hydraulic pressure sensor sends a second hydraulic measurement to the controller after the main screed is in the nulled position, the controller utilizing the second hydraulic pressure measurement to determine the tension state of the screed assembly, and the controller sending the rigid state adjustment signal to actuator device to place main screed in the rigid state.

12. The screed of claim 9, in which the actuator device includes a position sensor, the position pressure sensor sending a position sensor measurement to the controller after the main screed is in the nulled position, the controller utilizing the position sensor measurement to determine the tension state of the screed assembly, and the controller sending the rigid state adjustment signal to actuator device to place the main screed in the rigid state.

13. A work machine, comprising:

a tractor portion, the tractor having:

a frame, a traction system supporting the frame configured to move the traction portion along a paving reference, and an operation station supported by the frame;

a screed assembly, the screed assembly having:

a screed frame including one or more screeds including a main screed, a drop arm attached to the main screed by a drop arm pivot pin, the drop arm configured to attach the screed assembly to the work machine, an actuator device configured to adjust the screed assembly from a neutral position to a nulled position by rotating the one or more screeds around an axis of the drop arm pivot pin, the neutral position being when the main screed is supporting the full weight of the screed assembly on a paving reference and the nulled position being when each trailing edges of the one or more screeds are supporting the full weight of the screed assembly on the paving reference, and a controller configured to determine the screed assembly is in the neutral position based on a grade control measurement received from a grade control sensor, and the controller configured to automatically adjust the screed assembly to the nulled position if the controller determines the screed assembly is in the neutral position by sending a null adjustment signal to the actuator device, the actuator device rotating the screed assembly from the neutral position to the nulled position in response to the null adjustment signal.

14. The work machine of claim 13, in which the screed frame further includes at least one extension screed, the extension screed being fixed, hydraulically extendable, or hydraulically retractable to adjust a paving width of the work machine.

15. The work machine of claim 14, in which the extension screed is moved from the neutral position to the nulled position concurrently with the main screed.

16. The work machine of claim 13, in which in the neutral position a flat bottom surface of the main screed is engaged with a paving reference.

17. The work machine of claim 13, further comprising an operator control configured to receive an input and send a screed assembly nulling signal to the controller, the controller determining the position after receiving the screed assembly nulling signal.

18. A method for automatedly nulling a screed, the method comprising:

attaching a screed assembly at a screed frame of the screed assembly to a work machine with a drop arm, the drop arm attached to the screed assembly by a drop arm pivot pin, the screed assembly including one or more screeds including a main screed;

determining at a controller the screed assembly is in a neutral position based on a grade control measurement received from a grade control sensor, the neutral position being when the main screed is supporting the full weight of the screed assembly on a paving reference and the nulled position being when each trailing edges of the one or more screeds are supporting the full weight of the screed assembly on the paving reference;

sending from the controller a null adjustment signal to an actuator device if the controller determines the screed assembly is in the neutral position;

automatically adjusting with the actuator device the main screed from the neutral position to a nulled position by rotating the main screed around an axis of the drop arm pivot pin in response to the null adjustment signal.

19. The method of claim 18, in which after the main screed is in the nulled position, sending to the controller a tension measurement from a tension measurement sensor, determining at the controller a tension state of the screed assembly utilizing the tension measurement, sending from the controller to the actuator device a rigid state adjustment signal, moving with the actuator device the screed assembly into a rigid state in response to the rigid state signal.

20. The method of claim 19, in which the controller determines the main screed is in the neutral position from a grade control measurement from a grade control sensor of the main screed.

* * * * *